US008017849B2

(12) United States Patent
Tajima et al.

(10) Patent No.: US 8,017,849 B2
(45) Date of Patent: Sep. 13, 2011

(54) ELECTRONIC KEYBOARD INSTRUMENT

(75) Inventors: Shinji Tajima, Hamamatsu (JP); Shinya Koseki, Fukuroi (JP)

(73) Assignee: Yamaha Corporation, Hamamatsu-shi (JP)

( * ) Notice: Subject to any disclaimer, the term of this patent is extended or adjusted under 35 U.S.C. 154(b) by 43 days.

(21) Appl. No.: 12/412,518

(22) Filed: Mar. 27, 2009

(65) Prior Publication Data

US 2009/0241756 A1 Oct. 1, 2009

(30) Foreign Application Priority Data

Mar. 31, 2008 (JP) ..... 2008-092857

(51) Int. Cl.
*G10H 7/00* (2006.01)

(52) U.S. Cl. ..... 84/604; 84/601; 84/622; 84/625; 84/659; 84/660; 84/743; 84/744

(58) Field of Classification Search ..... None
See application file for complete search history.

(56) References Cited

U.S. PATENT DOCUMENTS

| | | | | |
|---|---|---|---|---|
| 7,002,068 | B2 * | 2/2006 | Koseki et al. | 84/604 |
| 7,521,626 | B2 * | 4/2009 | Muramatsu | 84/719 |
| 7,563,973 | B2 * | 7/2009 | Koseki et al. | 84/601 |
| 7,572,969 | B2 * | 8/2009 | Koseki et al. | 84/615 |
| 2003/0196539 | A1 * | 10/2003 | Koseki et al. | 84/604 |
| 2006/0000343 | A1 * | 1/2006 | Koseki et al. | 84/604 |
| 2006/0005691 | A1 * | 1/2006 | Koseki et al. | 84/604 |
| 2007/0017350 | A1 * | 1/2007 | Uehara | 84/609 |
| 2009/0178533 | A1 * | 7/2009 | Koseki et al. | 84/171 |

FOREIGN PATENT DOCUMENTS

| | | |
|---|---|---|
| CN | 1455384 A | 11/2003 |
| JP | 2003-316358 | 11/2003 |

OTHER PUBLICATIONS

Shure, Inc. (2009). "Microphone Techniques for Recording," *Shure, Inc.*, 40 pages.

Chinese Office Action mailed Apr. 28, 2011, for CN Patent Application No. 200910132526.4, with English Translation, nine pages.

* cited by examiner

*Primary Examiner* — Marlon T Fletcher
(74) *Attorney, Agent, or Firm* — Morrison & Foerster LLP

(57) ABSTRACT

Electronic piano includes speakers arranged on its front side region and another speaker provided at a back position of the piano. Waveform memory provided in a tone generator section has prestored therein sets of four-channel waveform data, each of the sets corresponding to a tone. The four-channel waveform data are data recorded from a natural musical instrument via four microphones installed at sampling positions corresponding to the above-mentioned speakers. The microphones are installed with the on-microphone setting in which the microphones are positioned close to sounding members of the natural musical instrument. In response to depression of a key, any one of the sets of four-channel waveform data, corresponding to a tone pitch designated by the key depression, is read out from the waveform memory, so that the four-channel waveform data are supplied in parallel to the individual speakers.

7 Claims, 5 Drawing Sheets

ELECTRONIC KEYBOARD INSTRUMENT

BACKGROUND

The present invention relates to an electronic keyboard instrument which can achieve substantially the same acoustic effects as achieved by a natural musical instrument.

Among the conventionally-known tone generation methods for electronic musical instruments are one which records waveforms of tones generated by a natural musical instrument, stores, into a waveform memory, the recorded waveforms of the tones as digital waveform data encoded by the PCM coding scheme or the like and then reads out the waveform data from the waveform memory when tones are to be generated by the electronic musical instrument.

Further, among the conventionally-known piano-type electronic keyboard instruments (hereinafter referred to as "electronic pianos") are one which has, as a tone source, a waveform memory that records (i.e., samples) tones of an acoustic (i.e., natural) grand piano in three channels in such a manner that a set of waveform data of three channels is stored in the waveform memory per tone (or note) corresponding to a single key depression operation. More specifically, for recording a set of waveform data of three channels, a tone generated by the grand piano is stereophonically recorded, using a stereophonic pair of unidirectional or non-directional microphones, in two channels corresponding to the two microphones, and indirect sounds generated simultaneously with the piano tone and containing a resonance and the like is recorded, using a monaural non-directional microphone, in one channel.

In an electronic piano disclosed in Japanese Patent Application Laid-open Publication No. 2003-316358, which is designed to reproduce stereophonically-recorded waveform data of two channels via stereophonic two-channel speakers and reproduce one-channel indirect sound waveform data via a monaural one-channel speaker, specific installed positions of the speakers are determined with only a stereophonic effect of performed tones taken into primary account. Further, when recording stereophonic two-channel waveform data, a stereophonic pair of microphones are installed with the "off-microphone" setting, where the microphones are positioned distant from sounding sources (strings and soundboard) of the grand piano, so that stereophonic waveforms can be picked up with good balance. Further, one monaural non-directional microphone too is installed with the off-microphone setting with a view to picking up indirect sounds.

Generally, in the case of a home electronic piano, a human player of the electronic piano is an initial listener of a performed tone. Thus, for a piano tone color (e.g., grand piano tone color) of the electronic piano, it is desirable that a performed tone, particularly heard at the position of the human player (i.e., by the human player) be, a realistic reproduction of acoustic characteristics of an acoustic grand piano. However, the piano tone color (grand piano tone color) of the prior art electronic piano can not sufficiently reproduce the acoustic characteristics of the acoustic grand piano; particularly, the prior art technique can not achieve substantially the same acoustic effects as achieved by the acoustic grand piano, namely, it can not achieve a sufficient reality and depth feeling of a performed tone heard at the position of the human player.

SUMMARY OF THE INVENTION

In view of the foregoing, it is an object of the present invention to provide an improved electronic keyboard instrument which can achieve substantially the same acoustic characteristics as achieved by an acoustic (natural) grand piano and particularly can sufficiently reproduce a reality and depth feeling of a performed tone of the grand piano heard at the position of a human player performing the electronic keyboard instrument.

In order to accomplish the above-mentioned object, the present invention provides an improved electronic keyboard instrument, which comprises: a keyboard including a plurality of keys; a casing having the keyboard provided on a front side thereof, the casing having a surface extending in a direction from the front side toward a back side thereof; a plurality of speakers provided on the surface of the casing extending in the direction from the front side toward the back side, the plurality of speakers including three or more speakers arranged substantially parallel to a key-arranged direction of the keyboard, and at least one speaker provided backwardly of the three or more speakers; a waveform memory having stored therein a plurality waveform data sets each comprising waveform data of a plurality of channels, the waveform data of the plurality of channels being prepared by recording a sound generated by a natural musical instrument, using a plurality of sound pickup devices set close to sounding members of the natural musical instrument arising the sound and positioned analogously to the arrangement of said plurality of speakers on said surface; a tone signal generation device that reads out, from the waveform memory, the waveform data of the plurality of channels corresponding to a tone designated by key depression on the keyboard and generates tone signals of the plurality of channels based on the read-out waveform data; and a supply device that supplies the tone signals of the plurality of channels, generated by the tone signal generation device, to respective ones of the speakers corresponding in positional arrangement to the plurality of sound pickup devices used for recording the waveform data of the channels.

In an embodiment, the waveform data of the plurality of channels are data recorded with the pickup devices positioned relatively close to the sounding members of the natural musical instrument. Preferably, the natural musical instrument is a grand piano.

Of the plurality of sound pickup devices employed in the present invention, three or more sound pickup devices, corresponding to the three or more speakers arranged on a front side region of the casing substantially parallel to the key-arranged direction of the keyboard, are provided on the front side region in front of a human player playing the keyboard and close to the sounding members (e.g., strings and soundboard) of the natural musical instrument. Thus, the present invention can store, into the waveform memory, waveform data of a sound component occupying the greatest part among sound components heard at the position of the human player and a sound (or tone) produced by a hammer striking a corresponding string of the natural musical instrument. Thus, tone signals corresponding to a sound component occupying the greatest part among sound components heard at the position of the human player and a sound produced by a hammer striking a corresponding string are primarily sounded (i.e., audibly reproduced) through the three or more speakers arranged on the front side region of the casing substantially parallel to the key-arranged direction of the keyboard. Further, the sound pickup device corresponding to the at least one speaker installed backwardly of the three or more speakers is positioned close to the sounding members (strings and soundboard) of the natural musical instrument at a back position remote from the human player of the natural musical instrument (e.g., grand piano), and thus, waveform data of a sound generated from a back position remote from the human player of the grand piano can be stored into the waveform memory.

Thus, a tone signal corresponding to a sound generated from a back position remote from the human player of the grand piano is sounded through the at least one speaker installed at the back position. With the plurality of sound pickup devices installed close to the sounding members of the natural musical instrument, the present invention can store, into the waveform memory, waveform data obtained by clearly recording a pure sound or tone produced from the sounding members. Thus, where the natural musical instrument is a grand piano, for example, a pure sound or tone produced by a string and soundboard can be obtained at the installed positions of the individual sound pickup devices.

According to the present invention, where the three or more speakers are arranged on the front side region of the casing, in substantial parallel relation to the key-arranged direction of the keyboard, to audibly generate or sound tone signals that correspond to a sound component occupying the greatest part among sound components heard at the position of the human player and a sound produced by a hammer striking a corresponding string, it is possible to realistically reproduce horizontal spaciality or extensity of a sound produced by the natural musical instrument (grand piano). Further, by a tone signal corresponding to a sound generated from a back position remote from the human player of the natural musical instrument (grand piano) being sounded through the at least one speaker installed at the back position, the present invention can reproduce a horizontal spread feeling of a sound produced by the natural musical instrument (grand piano). Further, because the sound pickup devices for recording waveform data are positioned relatively close to the sounding members, the present invention can record, as waveform data, a pure sound produced from the sounding members (string and soundboard) of the natural musical instrument (grand piano) and audibly reproduce tone signals corresponding to the pure sound produced from the sounding members.

Namely, with the present invention, in which the three or more speakers are arranged on the front side region of the upper surface of the casing, extending backward from the front side and the at least one speaker is provided backwardly of the three or more speakers and in which waveform data picked up at positions corresponding to the installed positions of the three or more four speakers and at least one other speaker, distributively provided on the upper surface of the casing, are reproduced through these speakers, the present invention can reproduce, in a realistic manner, acoustic characteristics of a sound of the natural musical instrument (grand piano), such as a spatial spread of a sound of the natural musical instrument, namely, an atmosphere and rich depth feeling with which the soundboard, extending backward or away from the human player, is sounded at its entire surface. Particularly, the present invention can reproduce, in an extremely realistic manner, a performed sound of the natural musical instrument heard at the position of the human player.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 3A and 3B are explanatory of how microphones are positioned when recording waveform data to be stored into a waveform memory, of which FIG. 3A is a top plan view of a natural (acoustic) grand piano and FIG. 3B is a side view of the grand piano take in a direction of arrow X;

FIGS. 4A-4C are explanatory of intervals or distances between strings of the natural grand piano and two microphones, of which FIG. 4A is a diagram showing the conventional "off-microphone" setting, FIG. 4B is a diagram showing the two microphones positioned closer to the strings and FIG. 4C is a diagram an example where a greater number of microphones than those in FIG. 4B are employed;

DETAILED DESCRIPTION

Figure 1:
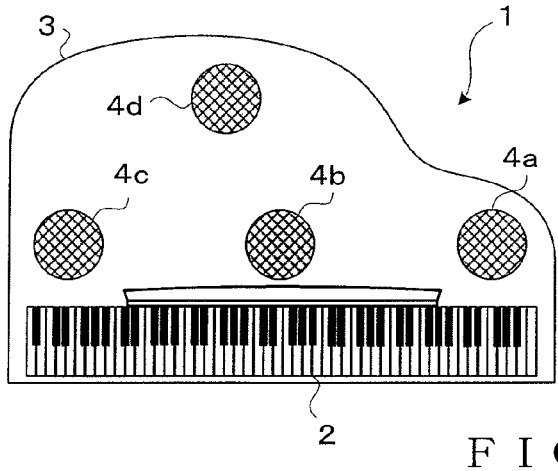
FIG. 1 is a top plan view of an electronic keyboard instrument (electronic piano) according to an embodiment of the present invention.

FIG. 1 is a top plan view of an electronic keyboard instrument 1 according to an embodiment of the present invention. The electronic keyboard instrument 1 includes: a keyboard 2 having a plurality of keys operable by a human player for executing a performance; a casing 3 retaining the keyboard 2 in place; and four speakers 4*a*, 4*b*, 4*c* and 4*d* provided on the upper surface of the casing 3. Tone signals are electronically generated, using a tone generator section comprising electronic circuitry, in response to human player's operation on the keyboard 2, and analog audio signals corresponding to the generated tone signals are audibly generated or sounded via the speakers 4*a*-4*d*. The electronic keyboard instrument 1 is an "electronic piano" designed to primarily generate tones of a piano tone color. In this specification, the electronic keyboard instrument 1 is sometimes referred to as "electronic piano". Further, in this specification, a side of the electronic keyboard instrument 1 where the keyboard 2 is provided (i.e., a side which the human player faces) will be referred to as "front side" of the electronic keyboard instrument (electronic piano) 1, and a side of the electronic keyboard instrument 1 opposite from the front side will be referred to as "back side" of the electronic keyboard instrument (electronic piano) 1. Lower side in FIG. 1 corresponds to the "front side" of the electronic keyboard 1, while an upper side in FIG. 1 corresponds to the "back side" of the electronic keyboard 1. As shown, the keyboard 2 is located on the front side of the casing 3.

The casing 3 is shaped as a grand piano type casing having a relatively large surface extending backward from the front side. The casing 3 of the electronic keyboard 1 has a smaller depth (i.e., front-to-back dimension) than the casing of the acoustic (natural) grand piano. Of the above-mentioned four speakers 4*a*-4*d*, the speakers 4*a*, 4*b* and 4*c* are arranged, on a front side region of the casing 3, in a row substantially parallel to a key-arranged direction of the keyboard 2, and the speakers 4*a*, 4*b* and 4*c* are located to the left, middle and right of the human player as viewed in a back-to-front direction. The left and right speakers 4*a* and 4*b* are located in substantial left-right symmetry about the middle speaker 4*b*. Further, the speaker 4*d* is located at the back of the casing 3 remotely from the human player. In this specification, the speaker 4*a* located to the left of the human player will be referred to as "L-channel speaker", the speaker 4*b* located to the middle of the human player as "C-channel speaker", the speaker 4*c* located to the right of the human player as "R-channel speaker", and the speaker 4*d* located at the back of the casing 3 remotely from the human player "S-channel speaker".

Installed positions of these four speakers 4*a*-4*d* correspond to installed positions of microphones relative to the grand piano (i.e., waveform data sampling positions) used at the time of recording (sampling) of waveform data of four channels to a later-described waveform memory. In the instant embodiment of the electric piano 1 of the present invention, the speakers 4*a*-4*d* audibly generate or sound piano tones based on the waveform data recorded at the positions corresponding to the speakers 4*a*-4*d*, so that the sounded piano tones can have a spatial spread as when the corresponding waveform data were sampled. Namely, the instant embodiment of the electric piano 1 can appropriately reproduce, in a realistic manner, an atmosphere and rich depth feeling with which the soundboard of the acoustic piano is sounded at its surface and particularly excellent acoustic characteristics of performed tones of the piano 1 heard at the position of the human player, as will be clear from the following description.

Figure 2:
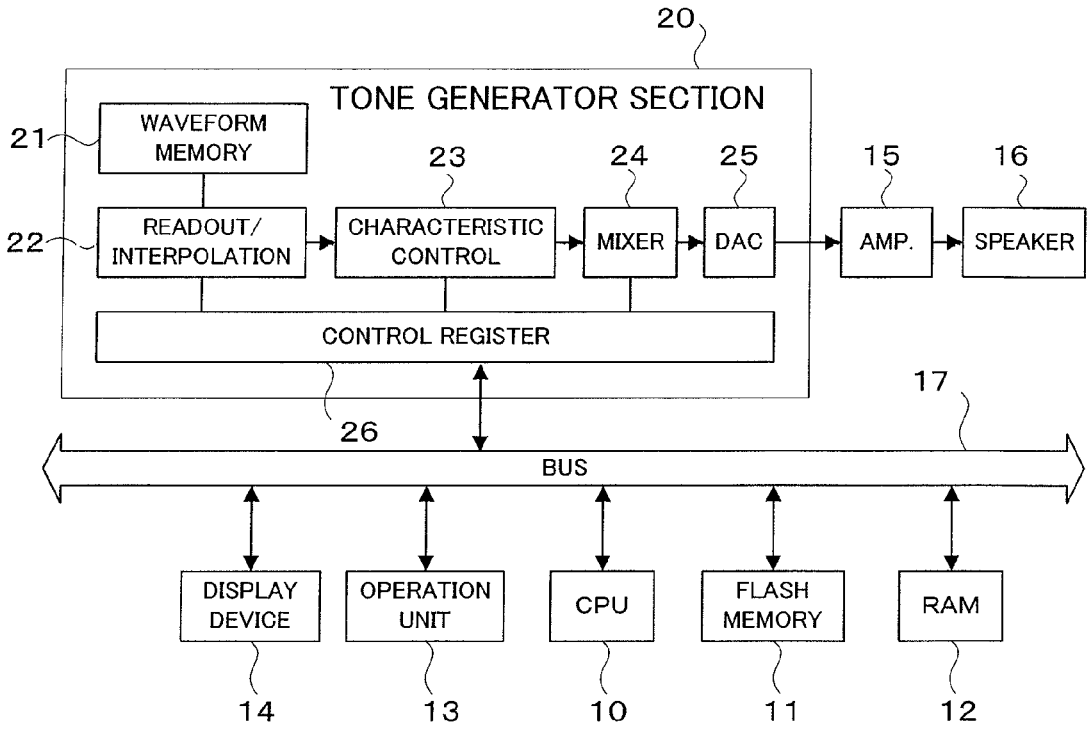
FIG. 2 is a block diagram showing an example electric hardware setup of the electronic piano of FIG. 1.

FIG. 2 is a block diagram showing an example electric hardware setup of the electronic piano 1 of FIG. 1. In the electronic piano 1 of FIG. 1, a CPU 10, flash memory 11 and RAM 12 together constitute a control section (microcomputer) for controlling all operations of the electronic piano 1. To the control section are connected, via a bus line 17, an operation unit 13, display device 14 and tone generator section 20. The flash memory 11 stores therein various control programs to be executed by the CPU 10. Amplifier 15 for amplifying a tone signal (analog audio signal) generated by the tone generator section 20 is connected to the tone generator section 20, and a four-channel speaker unit 16 is connected to the amplifier 15. The speaker unit 16 of FIG. 2 corresponds to the four-channel speakers 4*a*, 4*b*, 4*c* and 4*d* shown in FIG. 1, and the amplifier 15 has four signal processing channels corresponding to the four channels of the speaker unit 16. The display device 14 displays various information under control of the CPU 10.

The operation unit 13 includes performance operating members for executing a performance, such as the keyboard 2 having a plurality of keys (in the illustrated example, 88 keys) and a damper pedal, setting operating members for setting parameters, such as a tone color parameter. Different tone pitches (notes) are assigned to the plurality of keys of the keyboard 2 (operation unit 13), and the human player can operate the keyboard 2 (operation unit 13) to input a tone generation instruction (note-on event) including note-on timing, note number designating a tone pitch (note), velocity data corresponding to a key depression intensity, etc. The CPU 10 performs a note-on event process in response to the note-on event input by the human player's operation on the keyboard 2, and it sends various control parameters to a control register of the tone generation 20.

The tone generator section 20 includes the waveform memory 21, a waveform readout/interpolation section 22 connected to the waveform memory 21, a characteristic control section 23 connected to the waveform readout/interpolation section 22, a mixer section 24 connected to the characteristic control section 23, a digital-to-analog conversion (DAC) section 25 connected to the mixer section 24, and the control register 26. The control register 26 is a register for storing values of control parameters to be given to the waveform readout/interpolation section 22, characteristic control section 23 and mixer section 24. The tone generator section 20 performs a process for generating tone signals for a predetermined number of, e.g. 64, tone generating channels every sampling period (or cycle) on the basis of the various control parameters stored in the control register 26.

The waveform memory 21 has prestored therein a plurality of sets of four-channel waveform data, each of the sets being representative of one tone (note). The four-channel waveform data stored in the waveform memory 21 are data obtained by: recoding, for each tone pitch (note), a performed tone of an acoustic grand piano to four recording channels using four microphones installed at predetermined four positions; and then converting voltage values of four-channel analog audio signals (of the piano tone), picked up by the four microphones, into digital audio data using a suitable conventionally-known coding scheme, such as the PCM coding scheme. The four-channel waveform data are stored in the waveform memory 21 in association with the four speakers 4*a*-4*d* (see FIG. 1) provided in the electronic piano 1.

Every sampling period (or cycle), the above-mentioned waveform readout/interpolation section 22 generates read addresses for the plurality of tone generating channels, reads out, from the waveform memory 21, the waveform data of the plurality of tone generating channels in accordance with the thus-generated read addresses, then interpolates between samples of the read-out waveform data, and then outputs interpolated waveform data of the plurality of tone generating channels. Further, every sampling period, the characteristic control section 23 controls characteristics, such as a tone color and tone volume, of the waveform data of the plurality of tone generating channels output from the waveform readout/interpolation section 22. In the instant embodiment, the mixer section 24 and DAC 25 each have four signal processing channels corresponding to the four different speakers. Every sampling period, the mixer section 24 forms waveform data of the four signal channels by controlling respective levels of the waveform data of the plurality of tone generating channels, output from the characteristic control section 23, in four different ways and then adding together the thus level-controlled waveform data. Further, every sampling period, the DAC 25 converts the digital waveform data of the four signal processing channels into analog audio signals and outputs the converted audio signals to corresponding channels of the amplifier 15.

Namely, the tone generator section 20 is arranged in such a manner that, every sampling period, tone signals are generated for the plurality of tone generating channels, level-controlled individually for each of the output channels (signal processing channels) and then added together. Namely, a tone signal of a given one of the tone generating channels can be output to a particular output channel by only the level to be applied to the particular output channel being set at a predetermined level with the levels of the other output channels set at zero (namely, $-\infty$ decibel).

As will be later detailed, the instant embodiment of the invention is arranged to form four tone signals, on the basis of the four-channel waveform data, in the four tone generating channels in response to one tone generating instruction (i.e., one key depression operation), and output the thus-formed four tone signals to the corresponding output channels.

The amplifier 15 amplifies the analog audio signal, input to each of the four signal processing channels, with a predetermined gain value. The analog audio signals (tone signals) thus amplified by the amplifier 15 are supplied to corresponding ones of the four-channel speaker unit 16 (i.e., speakers 4*a*, 4*b*, 4*c* and 4*d* of FIG. 1), so that piano tones corresponding to the four-channel analog audio signals are sounded practically simultaneously through the four speakers of the speaker unit 16. Namely, tone signals corresponding to tones (i.e., performed tones of the electronic piano 1) picked up at four positions, corresponding to the installed positions of the speakers 4*a*-4*d*, of the grand piano, are audibly produced or sounded through the speakers 4*a*-4*d*. Thus, as a whole, the electronic piano 1 can reproduce a spatial spread of performed tones very much similar to that achieved by the acoustic grand piano, i.e. an atmosphere and rich depth feeling with which the soundboard, spreading backward from the front side, is sounded at its entire surface.

Figure 3A:
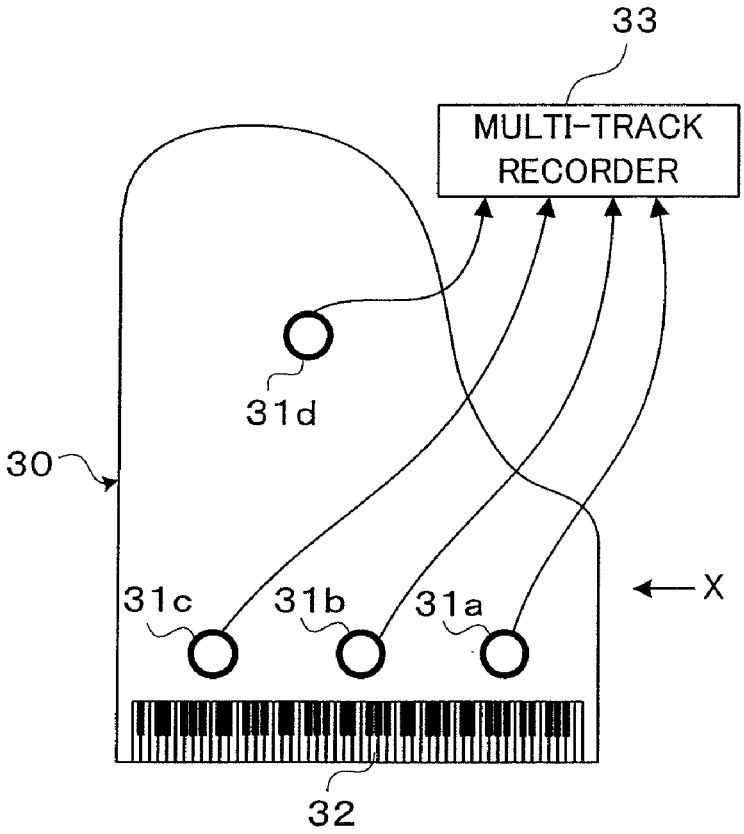
Figure 3B:
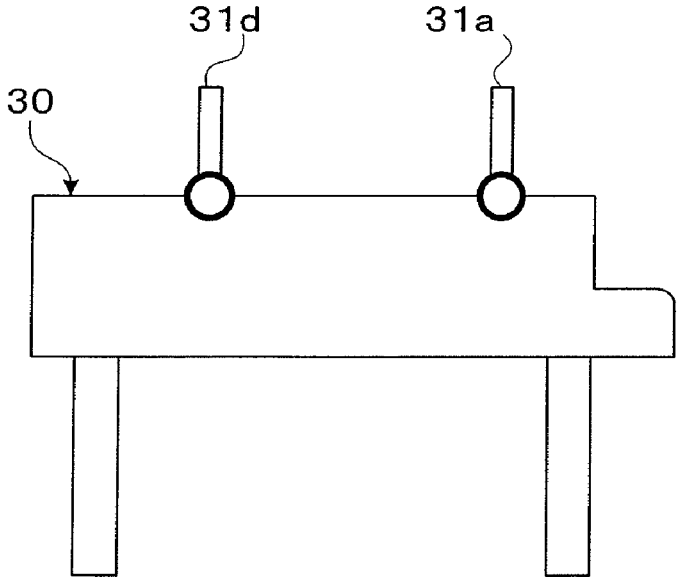

FIGS. 3A and 3B are diagrams explanatory of how the microphones (sound pickup devices) are positioned relative to the piano at the time of recording of waveform data to be stored into the waveform memory 21 in the instant embodiment. More specifically, FIG. 3A is a top plan view of the natural (acoustic) grand piano 30 whose performed tones are to be recorded to the waveform memory 21, and FIG. 3B is a side view of the natural (acoustic) grand piano take in a direction of arrow X. In the instant embodiment, four unidirectional (e.g., cardioid-type) microphones 31*a*, 31*b*, 31*c* and 31*d* are used to pick up performed tones of the piano 30. The microphones 31*a*-31*d* are connected to respective ones of recording channels of a multi-track recorder 33. Four-channel tones of the grand piano 30 picked up by the respective microphones 31*a*-31*d* are recorded into the channels of the multi-track recorder 33 corresponding to the microphones 31*a*-31*d*.

In the grand piano 30, a keyboard 32 having 88 keys is provided on a front side of a casing which a human player of the grand piano 30 faces. As well known, the keys of the keyboard 32 are arranged in such a manner that tone pitches assigned to the keys increase half step by half step in a left-to-right direction as viewed from the human player. Inside the casing of the grand piano 30, a plurality of strings (sounding sources or members) corresponding to tone pitches of the 88 keys are stretched taut in a direction generally from the front side toward the back of the grand piano 30 (in an up-down direction of FIG. 3A). Once one of the keys is depressed by the human player, a hammer corresponding to the depressed key strikes the corresponding string. Also, a soundboard is provided inside the casing of the grand piano 30. Vibration of the string produced by the hammer's striking is transmitted to the soundboard, where the vibration is caused to resonate and expand.

Of the four microphones 31*a*-31*d*, the microphones 31*a*, 31*b* and 31*c* are arranged on a front side region of the casing, substantially over a horizontal row of dampers provided within the casing of the grand piano 30, in a row substantially parallel to a key-arranged direction of the keyboard 32. The microphones 31*a*, 31*b* and 31*c* are located to the left, middle and right of the human player as viewed in the back-to-front direction, and the microphone 31*d* is located at a back position of the casing remotely from the human player. As well known, of the strings of the grand piano, the strings in a low-pitch key range and the strings in a medium-pitch key range are stretched in such a manner as to partly vertically crossing each other. The microphone 31*d* is installed substantially over a region where the strings in the low-pitch key range and the strings in the medium-pitch key range cross each other as noted above.

As shown in FIG. 3B, the four microphones 31*a*-31*d* are installed with their directivity oriented toward the sounding sources or members (strings and soundboard) of the grand piano 30, and the microphones 31*a*-31*d* are installed with the "on-microphone" setting where the sounding sources or members (strings and soundboard) and tone receiving points of the microphones are positioned close to each other. According to the "on-microphone" setting, as well known, each of the microphones can intensively and clearly pick up a tone produced from a particular portion aimed at as a pick-up target.

As noted above, the microphones 31*a*, 31*b* and 31*c* are located substantially over the dampers of the grand piano 30. The installed positions of the microphones 31*a*-31*c* are where a sound component occupying the greatest part among sound components heard at the position of the human player can be appropriately picked up, and also where a tone produced by a given hammer striking the corresponding string can be picked up most efficiently. Thus, by providing the microphones 31*a*-31*c* substantially over the dampers with the on-microphone setting, it is possible to clearly pick up, for each of high-pitch, medium-pitch and low-pitch key ranges, tones (i.e., tones produced by the strings and the soundboard and having a small quantity of indirect sounds) important for realistically reproducing a listening feel, at the position of the human player, of piano performed tones, such as a sound component occupying the greatest part among sound components heard at the position of the human player and a sound produced by a hammer striking a corresponding string.

Figure 4A:
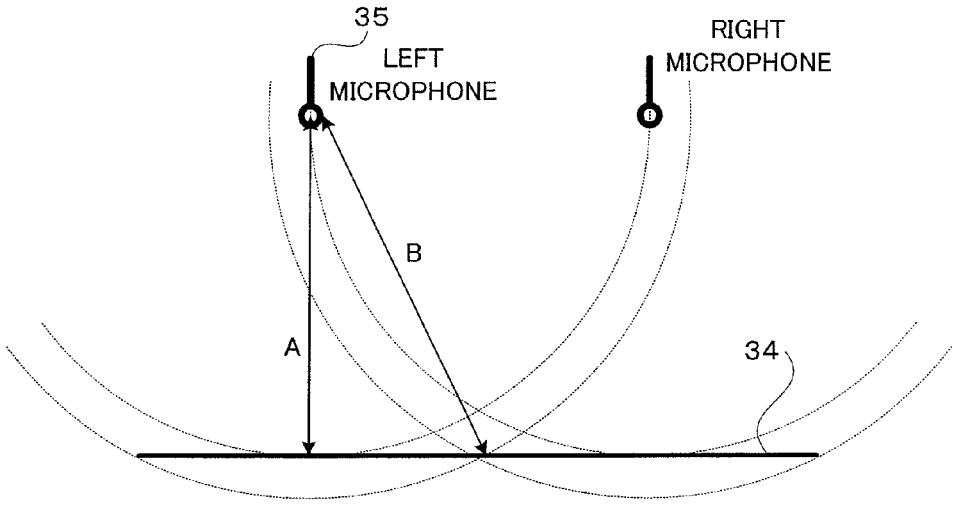

Now, with reference to FIGS. 4A through FIG. 5C, a description will be given about relationship between the number of the microphones 31*a* to 31*c* positioned on the front side region and distances between the microphones and the strings (sounding members). Each of FIG. 4A through FIG. 5C shows the grand piano from the front. Straight line 34 is a schematic representation of the plurality of strings (corresponding to 88 tone pitches) provided inside the casing of the grand piano. The left end of the straight line 34 represents a position of the string corresponding to the lowest tone pitch (note name "A0"), while the right end of the straight line 34 represents a position of the string corresponding to the highest tone pitch (note name "C8"). FIG. 4A shows an example of the microphone setting employed for recording stereophonic two-channel waveform data using a pair of left and right microphones 35 as disclosed in the above-mentioned No. 2003-316358 publication. Reference character A in FIG. 4A etc. indicates the smallest distance between the tone receiving portion of each of the microphones 35 and the string 34 located closest to the microphone 35 in a sound pickup range of the microphone 35, and reference character B in FIG. 4A etc. indicates the greatest distance between the tone receiving portion of each of the microphones 35 and the string 34 located remotest from the microphone 35 in the sound pickup range of the microphone 35; these are distances between one of the plurality of microphones 35 and the closest and remotest strings in the pickup range of the microphone 35. Where a plurality of microphones are used in a given range, it is only necessary that any one of the microphones be installed in the on-microphone setting to pick up a tone. If a difference between the smallest distance A and the greatest distance B is relatively great, a tone produced from the string closer to the tone receiving portion of the microphone 35 and a tone produced from the string remoter from the tone receiving portion of the microphone 35 will result in a great difference in sound quality between recorded waveform data. Thus, if a plurality of sets of waveform data of a plurality of tone pitches are recorded by striking a plurality of strings, the sound quality of the plurality of sets of waveform data will differ from each other in a tone pitch direction. Therefore, it is desirable that the difference between the smallest distance A and the greatest distance B be as small as possible. Further, in a case where waveform data are to be recorded with the "off-microphone" setting as shown in FIG. 4A, it has been conventional to increase the distance between the string 34 and each of the microphones 35 (e.g., set the distance at about 60 cm) and position the two microphones 35 with a sufficiently great left-right distance, so as to reduce the difference between the smallest distance A and the greatest distance B and thereby record stereophonic waveforms with a good balance over the entire pitch (or key) range of the piano. In such a case, however, because the distance between the sounding members and each of the microphones 35 becomes greater, it is not possible to intensively and clearly pick up a tone produced from a particular portion (i.e., only a tone produced by the string and the soundboard).

Figure 4B:
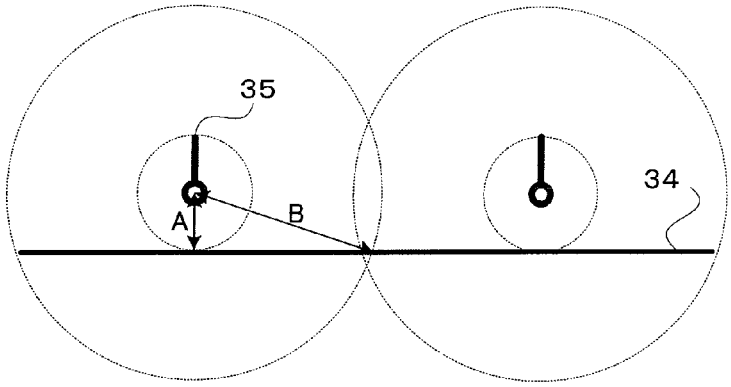

It has been experimentally found that, in order to record only a "pure sound or tone produced by a string and the soundboard", it is necessary to set the greatest distance between the string 34 and the microphone 35 at about 25 cm (i.e., such that a ratio of the greatest distance B to the smallest distance A is "2.5" or less) at the most. However, if the two microphones 35 are positioned close to the string 34 (i.e., if the on-microphone setting is employed), then the difference between the smallest distance A and the greatest distance B undesirably becomes greater as shown in FIG. 4B.

Figure 4C:
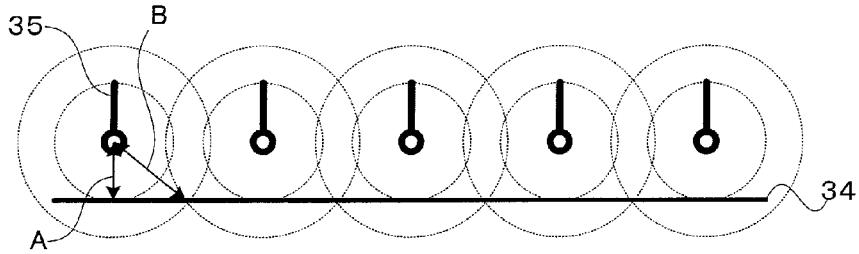

In order to reduce the difference between the smallest distance A and the greatest distance B, it is only necessary to increase the number of the microphones 35 to be arranged in the left-right direction as shown in FIG. 4C. In the illustrated example of FIG. 4C, five microphones 35 are arranged in the key-arranged direction. As the number of the microphones 35 is increased, the difference between the smallest distance A and the greatest distance B can be reduced, so that waveform data sampled by the microphones 35 can be made uniform in sound quality in the tone pitch direction. However, because the increased number of the microphones 35 requires an increased number of sampling points and hence an increased number of channels of waveform data to be stored, a greater memory capacity would be required.

Figure 5A:
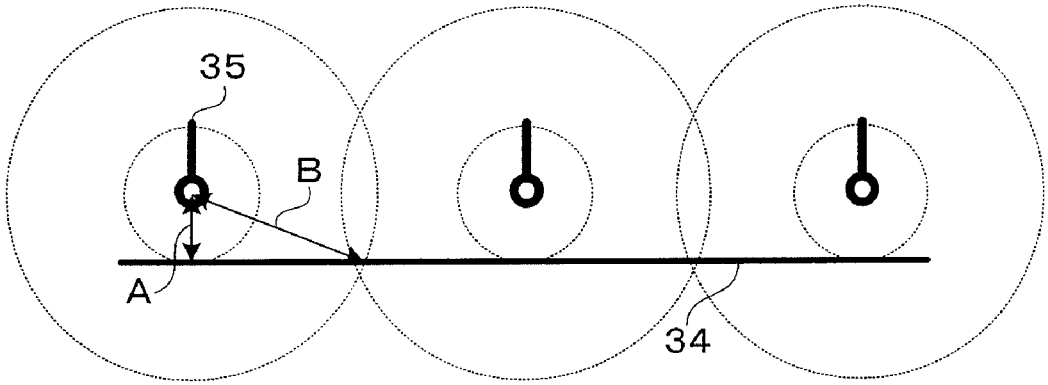
FIGS. 5A-5C are diagrams explanatory of the on-microphone setting employed in the embodiment.
Figure 5B:
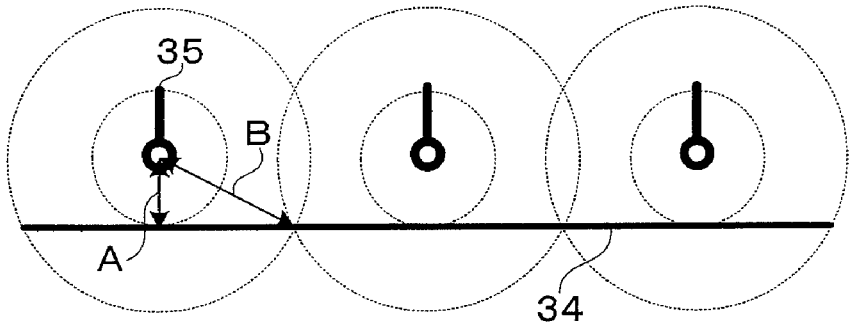

In the illustrated example of FIG. 5A, only three of the five microphones 35 shown in FIG. 4C, i.e. the middle and leftmost and rightmost microphones, are employed with the other microphones removed. With the arrangement of the microphones 35 shown in FIG. 5A, the strings located in the neighborhood of boundaries between the pickup range of the middle microphone and the pickup ranges of the left and right microphones are located too remote from any of the microphones. If the left and right microphones are moved toward the middle as shown in FIG. 5B, the three microphones can be arranged in such a manner that the difference between the smallest distance A and the greatest distance B is reduced as a whole. If the smallest distance A between each of the microphones 35 and the corresponding sounding member (string 34) is set at 10 cm, the ratio of the greatest distance B to the smallest distance A can be reduced to about 2 (two) by adjusting distances between the three microphones so as to reduce the difference between the smallest distance A and the greatest distance B as shown in FIG. 5B, even through only three microphones 35 are employed. With the microphone performance today, waveform data can be recorded with no sound distortion, even if the smallest distance A between each of the microphones 35 and the corresponding sounding member (string 34) is set at about 10 cm. Thus, with the arrangement of the microphones shown in FIG. 5B, waveform data can be recorded, from pure tones produced by the strings and soundboard, at positions substantially over the dampers (i.e., in the neighborhood of hammer striking positions), with uniform sound quality throughout the entire pitch range of the grand piano; besides, this arrangement is optimal in that it does not require a great memory capacity for storing the waveform data.

Figure 5C:
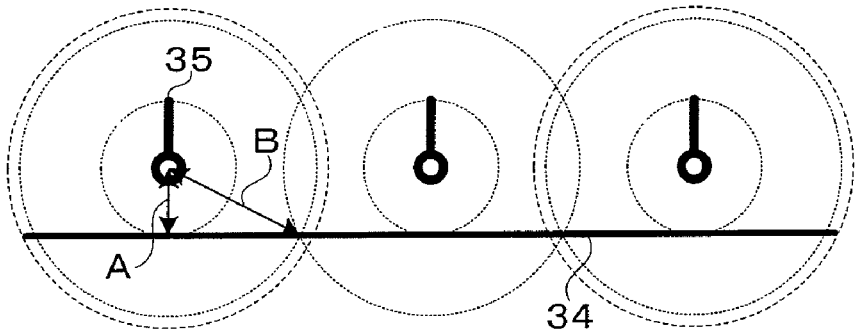

In the illustrated example of FIG. 5C, the left and right microphones are moved further toward the middle from their positions of FIG. 5B, as shown in FIG. 5C, so as to achieve a microphone setting that places more emphasis on recording tones produced from a middle pitch or key range of the grand piano 30.

Thus, by arranging the three microphones on the front side region of the grand piano 30 substantially over the dampers in such a manner that the difference between the smallest distance A and the greatest distance B is minimized as shown in FIG. 5B, it is possible to clearly record, for each of the high-pitch, medium-pitch and low-pitch key ranges, tones important for realistically reproducing performed tones of the grand piano heard at the position of the human player, such as a sound component occupying the greatest proportion among sound components heard at the position of the human player and a tone produced by striking of a string by the corresponding hammer.

Further, as well known, the strings of the piano decrease in length in a direction from the lowest-pitch key to the highest-pitch key (i.e., in a tone-pitch increasing direction). Thus, a tone produced by a string in the high-pitch key range can be picked up with a sufficiently high quality even by the microphone 31*a* alone. However, in the medium-pitch and low-pitch key ranges, a tone produced from a position remote from the damper (i.e., from a back position of the piano 30) can not be picked up sufficiently by the microphones 31*b* and 31*c* alone. But, in the instant embodiment, where the microphone 31*d* is provided, with the on-microphone setting, at a back position of the casing near a region where the strings of the low-pitch key range and the strings of the medium-pitch key range intersect each other, tones of the medium-pitch and low-pitch key ranges, produced by the strings and soundboard at back positions of the piano 30, can be clearly picked up by the microphone 31*d*.

Namely, in the instant embodiment of the invention, the three microphones 31*a*-31*c* are provided, with the on-microphone setting, on the front side region substantially over the dampers and along the key-arranged direction, the other microphone 31*d* is provided, with the on-microphone setting, at the back position near the region where the strings of the low-pitch key range and the strings of the medium-pitch key range intersect each other, and the piano tone of each individual tone pitch picked up by the individual microphones 31*a*-31*d* is recorded into the respective ones of the four recording channels of the multi-track recorder 33. Thus, as a whole, the instant embodiment can store, into the waveform memory 21, high-quality waveform data having acoustic characteristics of the natural grand piano, such as a spatial spread of the acoustic grand piano tones, i.e. an atmosphere and rich depth feeling with which the soundboard, spreading backward from the front side of the casing is sounded at its entire surface.

The four-channel waveform (full wave) data recorded in the aforementioned manner are then processed, in accordance with a conventionally-known method, to create four waveform data each comprising an attack portion and a loop portion following the attack portion, and the thus-created waveform data are stored into the waveform memory 21 as a set of waveform data. Then, waveform data corresponding to the L-channel speaker 4*a* is created on the basis of the waveform data recorded via the microphone 31*a*, waveform data corresponding to the C-channel speaker 4*b* is created on the basis of the waveform data recorded via the microphone 31*b*, waveform data corresponding to the R-channel speaker 4*c* is created on the basis of the waveform data recorded via the microphone 31*c*, and waveform data corresponding to the S-channel speaker 4*d* is created on the basis of the waveform data recorded via the microphone 31*d*. Of the thus-created four waveform data, the leading or start end of the waveform data corresponding to the S-channel speaker 4*d* is imparted, at the time of creation of its attack portion, with a silent waveform of several milliseconds. Thus, if the set of four waveform data are simultaneously reproduced, the attack of the tone waveform of the S-channel waveform data will be delayed behind the waveform data of the other channels by several milliseconds.

Because the piano tones differ in characteristic among pitch ranges (i.e., key ranges), it is desirable to prepare different waveform data per predetermined pitch range. Thus, in the instant embodiment, the 88 (eighty-eight) keys of the grand piano 30 are divided into predetermined pitch ranges, each comprising a plurality of keys (e.g., three keys), and four-channel waveform data are sampled per such pitch range to create four waveform data to be used in the tone generator section. Further, because the piano tones differ in tone volume velocity depending on the key depression intensity or velocity (touch) and also differ in tone characteristic depending on the tone volume velocity, it is desirable to create different waveform data per predetermined key depression intensity or velocity (touch) range. Thus, in the instant embodiment, the intensity or velocity levels of key depression are divided into a plurality of key depression key intensity (touch) ranges, four-channel waveform data are sampled for each of such key depression intensity (touch) ranges, to create four waveform data to be used in the tone generator section. In this specification, the pitch range and intensity key depression intensity range for which one set of waveform data are to be prepared will be referred to as "region". Namely, for the piano tone color to be recorded using the grand piano 30, the waveform memory 21 stores a plurality of sets of four-channel waveform data (each comprising an attack portion and loop portion) in association with a plurality of regions.

Further, as well known in the art, when the piano is performed with its damper pedal (or sustain pedal) depressed, the dampers corresponding to all of the keys are simultaneously detached from the strings. Thus, not only a tone of each depressed key can have an extended duration but also there occurs resonance between the tone, produced by the string being struck by the hammer of the depressed key, and the other strings not struck directly by the corresponding hammers, so that a unique performed tone can be obtained. In this specification, a piano sound additionally imparted to an ordinary piano-performed tone will be referred to as "damper sound". In order to realistically reproduce such a damper sound of the piano, the instant embodiment of the electronic piano 1 also stores, into the waveform memory 21, a set of four-channel waveform data of the damper sound (i.e., damper sound waveform data) per tone. Damper sound waveform data recorded via the microphone 31*a* is stored as D-L-channel damper sound waveform data corresponding to the L-channel speaker 4*a*, damper sound waveform data recorded via the microphone 31*b* is stored as D-C-channel damper sound waveform data corresponding to the middle-channel speaker 4*b*, damper sound waveform data recorded via the microphone 31*c* is stored as D-R-channel damper sound waveform data corresponding to the R-channel speaker 4*c*, and damper sound waveform data recorded via the microphone 31*d* is stored as D-S-channel damper sound waveform data corresponding to the S-channel speaker 4*d*.

For each of the keys, such damper sound waveform data is obtained by: first recording waveform data generated by depression of the key with the damper pedal left unoperated (i.e., waveform data in a damper-off state) and recording waveform data generated by depression of the key with the damper pedal operated (i.e., waveform data in a damper-on state); and then subtracting the waveform data in the damper-off state from the waveform data in the damper-on state. The damper sound waveform data is representative of effects (reverberation components) produced by the damper operation, such as extension of the sound and resonance effect of the strings. The damper sound waveform data too is processed into waveform data having an attack portion and loop portion, and then stored into the waveform memory 21. To audibly reproduce a damper sound (i.e., piano tone in the damper-on state) on the electronic piano 1, the waveform data of an ordinary piano tone of a designated tone pitch (note) and the corresponding damper sound waveform data are additively synthesized together.

Figure 6:
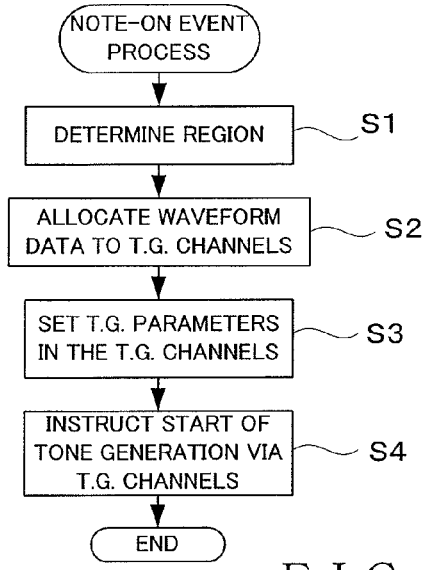
FIG. 6 is a flow chart showing an example operational sequence of a note-on event process performed by a CPU in the electronic piano of FIG. 1.
Figure 7:
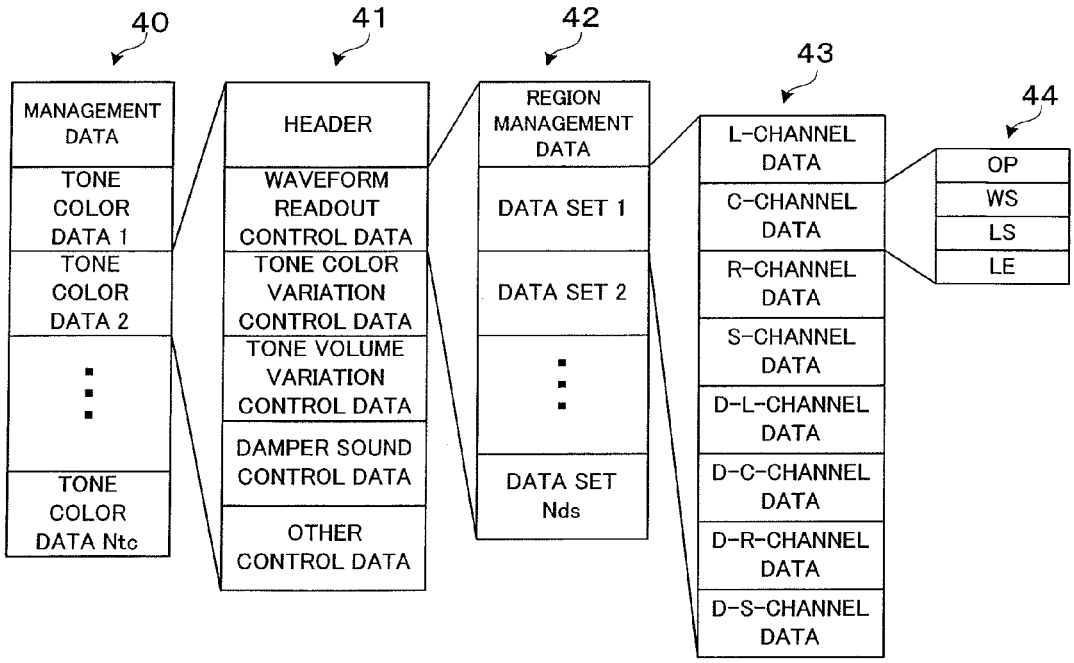
FIG. 7 is a diagram showing an example data organization of tone color data to be referred to in the note-on event process of FIG. 6.

FIG. 6 is a flow chart showing an example operational sequence of a note-on event process performed by the CPU 10 in the electronic piano 1. The following paragraphs describe the note-on event process performed in response to a note-on event that instructs generation of one tone responsive to depression operation of a single key by the human player. Further, FIG. 7 is a diagram showing an example data organization of tone color data to be referred to in the note-on event process of FIG. 6. A plurality of such tone color data are prestored in a suitable memory, such as the flash memory 11 or RAM 12, of the electronic piano 1.

In the illustrated example of FIG. 7, a plurality (Ntc) of tone color data (tone color data 1, tone color data 2, . . . , tone color data Ntc) are prestored in the memory, as indicated at reference numeral 40. The human player can select a tone color to be currently used (i.e., current tone color) from among the plurality (Ntc) of tone color data, by operating the operation unit 13. Each of the tone color data include, as control data 41 for controlling tone generation of the tone color, a header portion including tone-color indentifying data etc., waveform readout control data, tone color variation control data, tone volume variation control data, damper sound control data and other control data. The above-mentioned tone color variation control data, tone volume variation control data, damper sound control data and other control data are data for setting values of various parameters in the later-described tone generating channels. As indicated at 42 in FIG. 7, the waveform readout control data include region management data, data sets (data set 1, data set 2, . . . , data set Nds) stored in association with a plurality of regions, each of the data sets pertaining to readout of a set of waveform data of an ordinary tone and damper sound to be used in the corresponding region.

As indicated at 43, each of the data sets, which corresponds to one region, includes L-channel data, C-channel data, R-channel data and S-channel data pertaining to a piano tone in the damper-off state, and D-L-channel data, D-C-channel data, D-R-channel data and D-S-channel data pertaining to a damper sound. As indicated at 44, each of the above-mentioned channel data include data (OP) indicative of an original pitch of original waveform data which was sampled to create the waveform data (attack portion+loop portion) stored in the waveform memory 21, a waveform start address (WS) indicative of a start address of the attack portion of the waveform data, a loop start address (LS) indicative of a start address of the loop portion of the waveform data, and a loop end address (LE) indicative of an end address at which is stored sample point data of the end of the loop portion (i.e., end of repetitive read out).

Once one of the keys is depressed by the human player, note-on event data corresponding to the key depression is generated. The note-on event data include note-on data instructing a start of generation of a tone corresponding to the depressed key, note number data indicative of a pitch of the tone to be generated, and velocity data indicative of tone volume velocity corresponding to velocity of the key depression. For example, the note-on event data are data compliant with the MIDI (Musical Instrument Digital Interface) standard, and the note number data indicates the tone pitch (note) by one of 128 different numerical values (i.e., 0-127), and the velocity data indicates the key depression velocity (or intensity) by one of 128 different numerical values (i.e., 0-127).

At step S1, the CPU 10 determines a "region" on the basis of the region management data of the current tone color and the note number data and velocity data included in the note-on event data. Specifically, the note number values (i.e., 128 different values of "0"-"127") and the velocity values (i.e., 128 different values of "0"-"127") are divided, by the region management data, into a plurality of regions in such a manner that the divided regions do not overlap each other, and the plurality of data sets (data set 1, . . . , data set Nds) are prestored in corresponding relation to the plurality of regions as indicated at 42 in FIG. 7. Namely, each of the regions corresponds to any one of the data sets, and each of the data sets includes various data necessary for reading out waveform data in accordance with the region (i.e., pitch range or key depression intensity (or velocity) range. By the CPU 10 determining the "region" on the basis of the note number data and velocity data included in the note-on event data at step S1, so that a data set of waveform data corresponding to the pitch range represented by the note number data and a data set of waveform data corresponding to the key depression intensity (velocity) range represented by the velocity data are designated. Note that a different region management data set is prepared per tone color, and that the total number of regions set in the entire note number value range and velocity value range and the extents of the individual regions are chosen independently per tone cool.

At next step S2, the CPU 10 allocates the four-channel waveform data of the data set, corresponding to the determined region, to respective tone generating channels (TG channels) of the tone generator section 20 (waveform readout/interpolation section 22). If the damper pedal has not been operated at the time of the depression of the key (i.e., if the key has been depressed with the damper pedal left unoperated), four-channel (i.e., L-channel, R-channel, C-channel and S-channel) waveform data of an ordinary tone are allocated to respective four tone generating channels of the tone generator section 20. If the damper pedal has been operated at the time of the depression of the key (i.e., if the key has been depressed with the damper pedal left operated), four-channel (i.e., D-L-channel, D-R-channel, D-C-channel and D-S-channel) waveform data of a damper sound are read out in addition to the four-channel (i.e., L-channel, R-channel, C-channel and S-channel) waveform data. Thus, for the one tone corresponding to the depressed key, the waveform data of a total of eight channels are allocated to respective ones of eight tone generating channels of the tone generator section 20.

At step S3, the CPU 10 sets tone generating parameters in the four tone generating channels to which the four-channel waveform data of the ordinary tone have been allocated at step S2. Further, when a damper sound too is to be audibly generated, the CPU 10 also sets tone generating parameters in the four tone generating channels to which the four-channel waveform data of the damper sound have been allocated at step S2. Here, the parameters to be set in the individual tone generating channels include waveform readout parameters, tone color variation parameters, tone volume variation parameters, output-channel-by-output-channel level parameters, etc.

More specifically, for each of the tone generating channels to which the waveform data of an ordinary tone has been allocated, the waveform start address WS, loop start address LS and loop end address LE, pertaining to the waveform data of the corresponding channel, in the data set designated at step S1, and a waveform data readout speed (F number) based on a difference between the value of the note number and the original pitch OP, are set as the waveform readout parameters. Then, as the tone color variation parameters, values of parameters (filter envelope parameter etc.) for controlling tone color variation are set on the basis of the tone color variation control data of the current tone color. Further, values of parameters (amplitude envelope parameter etc.) for controlling tone volume variation are set on the basis of the tone volume variation control data of the current tone color. Further, parameters for controlling the levels of the output channels are set such that a tone signal is output only to the corresponding signal processing channel. For example, if the tone generating channel in question is one having the L-channel waveform data allocated thereto, then the output to the L-channel-corresponding tone generating channel is set at a predetermined level, and the outputs to the other tone generating channels are each set at zero. For each of the other tone generating channels having the C-channel, R-channel and S-channel waveform data allocated thereto, an output level to the signal processing channel corresponding to the C-channel, R-channel or S-channel are set at a predetermined level with output levels to the other signal processing channels set at zero, similarly to the above-mentioned.

Further, for each of the tone generating channels to which the waveform data of a damper sound has been allocated, the waveform start address WS, loop start address LS and loop end address LE, pertaining to the waveform data of the corresponding channel, in the data set designated at step S1, and a waveform data readout speed (F number) based on a difference between the value of the note number and the original pitch OP are set as the waveform readout parameters. Then, as the tone color variation and tone volume variation parameters, values of parameters for controlling tone color variation and tone volume variation are set on the basis of the damper sound control data of the current tone color. Further, parameters for controlling the levels of the output channels are set such that a tone signal is output only to the corresponding signal processing channel.

At step S4, the CPU 10 instructs the tone generator section 20 to start generating tones via all of the tone generating channels having the waveform data allocated thereto at step S2 above. Thus, each of the tone generating channels forms a tone signal based on the waveform data addressed in accordance with the parameters WS, LS and LE in the waveform memory 21. Namely, the waveform readout/interpolation section 22 starts reading out the waveform data at the waveform start address WS to continue the waveform data readout at a speed corresponding to the F number, and then, once the loop end address LE is reached, it jumps back to the loop start address. Namely, in accordance with address signals, the waveform readout/interpolation section 22 performs a process for reading out the attack portion of the waveform data and then repetitively reading out the loop portion. Because the readout speed (i.e., F number) is set at a value corresponding to a difference (calculated in cents) between the tone pitch (note) designated by the note-on event and the original pitch OP of the waveform data allocated to that tone generating channel, the waveform data read out from the waveform memory can be pitch-shifted so as to become a tone signal of the tone pitch designated by the note-on event during the course of the readout and interpolation. Whereas the waveform memory read scheme employed in the instant embodiment is a pitch-asynchronous scheme where the waveform memory read is synchronized to a predetermined sampling period, the present invention may employ a pitch-synchronous waveform memory read scheme.

In each of the tone generating channels, the waveform data read out from the waveform memory and subjected to inter-sample interpolation per sampling period (or cycle) is controlled in frequency and amplitude characteristics by the characteristic control section 23 on the basis of the tone color variation parameters and tone volume variation parameters set at step S3, and then output to the mixer section 24 as a tone signal. Then, in the mixer section 24, every sampling period, the tone signal of each of the tone generating channels is controlled in level for each of the output channels, and the thus-level controlled tone signals are added together for each of the output channels and then output as waveform data of the four signal processing channels. The waveform data of the four signal processing channels output from the mixer section 24 are each converted into an analog audio signal via the DAC 25, and amplified with a predetermined gain value. Then, the thus-amplified analog audio signals are supplied to the L-channel, C-channel, R-channel and S-channel speakers 4*a*-4*d* of the speaker unit 16 of FIG. 1 which correspond to the waveform data of the L, C, R and S channels.

To sum up the foregoing, when no damper sound is to be generated (i.e., in the damper-off state), four-channel waveform data of an ordinary tone are allocated to four tone generating channels of the tone generator section 20 in response to a single key depression operation, and four tone signals are formed in the four tone generating channels on the basis of the allocated four-channel waveform data and output via respective ones of the four signal processing channels. The waveform data of the four signal processing channels are converted into analog signals, power-amplified and then supplied to corresponding ones of the four-channel speakers.

When a damper sound is to be generated (i.e., an ordinary tone is to be generated in the damper-on state), four-channel waveform data of an ordinary tone and four-channel waveform data of a damper sound are allocated to eight tone generating channels of the tone generator section 20 in response to a single key depression operation. Then, four tone signals are formed in the four ordinary tone generating channels on the basis of the allocated four-channel waveform data of the ordinary tone, and for waveform signals are formed on the remaining four tone generating channels on the basis of the allocated four-channel waveform data of the damper sound. A total of eight signals thus formed are output via respective ones of the four signal processing channels. The waveform data of the four signal processing channels are converted into analog signals, power-amplified and then supplied to corresponding ones of the four-channel speakers.

In this way, tone signals (performed tone of the electronic piano 1), corresponding to a "tone generated by a string and the soundboard of the natural grand piano 30" recorded with the "on-microphone" setting via the three microphones 31*a*-31*c* installed on the front side region of the grand piano 30 substantially over the dampers, are audibly reproduced or sounded through the L-channel, C-channel and R-channel speaker 4*a*, 4*b* and 4*c* arranged on the front side region of the electronic piano 1 substantially parallel to the keyboard 2. Thus, the instant embodiment can realistically reproduce horizontal spaciality or extensity of a tone performed by the grand piano. In the instant embodiment, each of the tone signals audibly reproduced through the L-channel, C-channel and R-channel speaker 4*a*, 4*b* and 4*c* corresponds to a direct sound component generated from the piano which occupies the greatest part among piano sound components heard at the position of the human player and which includes vibration sound of the string, resonant sound of the soundboard, sound noise produced by the corresponding hammer striking the string, etc. These sounds are reproduced on the basis of the waveform data recorded with high quality at the individual sampling positions. Further, tone signals, corresponding to a "low- or medium-pitch tone produced by one of the strings and the soundboard at a back position of the natural grand piano" recorded with the "on-microphone" setting via the microphone 31*d* installed at back position of the grand piano 30, is audibly reproduced or sounded through the S-channel speaker 4*d* installed remotely from the keyboard 2. Thus, the instant embodiment can reproduce a feeling of a backward spread of a tone produced by a string in the low- or medium-pitch key ranges. Further, by the S-channel speaker 4*d* imparting a feeling of a backward spread to a performed tone of the electronic piano 1, the instant embodiment can realistically reproduce vibrancy of a damper sound.

Namely, in the instant embodiment of the electronic piano 1, in which the three speakers 4*a*-4*c* are arranged on the front side region of the upper surface of the casing 3 extending backward from the front side, and the speaker 4*d* is provided backwardly of the three speakers 4*a*-4*c* and in which waveform data picked up at positions corresponding to the installed positions of the four speakers 4*a*-4*d* are reproduced through the four speakers 4*a*-4*d* distributively provided on the upper surface of the casing 3. Thus, as a whole, the instant embodiment of the present invention can reproduce, in a realistic manner, acoustic characteristics of the grand piano, such as a spatial spread of a performed tone of the grand piano, namely, an atmosphere and rich depth feeling with which the soundboard of the acoustic piano, extending backward from the front side, is sounded at its entire surface, and particularly it can reproduce, in an extremely realistic manner, performed tones of the grand piano heard at the position of the human player.

Note that distances, in the left-right direction, between the three speakers 4*a*-4*c* arranged on the front side region of the electronic piano 1 may be greater than those between the corresponding microphones 31*a*-31*c* installed at the time of recording waveform data. In the electronic piano 1 shown in FIG. 1, the left and right speakers 4*a* and 4*c* are spaced apart from each other by a relatively great distance (i.e., located close to the left and right end edge of the electronic piano 1). By thus increasing the distances between the three speakers 4*a*-4*c* in the left-right direction, it is possible to emphasize a stereophonic feeling of a piano tone. Further, although the S-channel speaker 4*d* installed at a back position is located closer to the position of the human player than the corresponding microphone 31*d*, it can impart a sufficient depth feeling to a reproduced tone. Further, reproduction of the S-channel waveform data corresponding to the S-channel speaker 4*d* installed at the back position may be slightly delayed behind reproduction of the waveform data corresponding to the front-side L-channel, C-channel and R-channel speaker 4*a*, 4*b* and 4*c*, so as to even further emphasize the stereophonic feeling of a piano tone. For example, the address at which the leading end of the body of the S-channel waveform data may be slightly shifted behind the waveform start addresses WS of the waveform data of the other three channels so that readout timing of the S-channel waveform data can be delayed behind that of the other three channels.

Further, the embodiment of the present invention has been described in relation to the case where are provided the four-channel speakers, including the three speakers 4*a*-4*c* arranged on the front side region and one speaker 4*d* provided backwardly of the three speakers 4*a*-4*c*, where a set of four-channel waveform data are stored in the waveform memory 21 in association with the four-channel speaker, and where, at the time of recording of such four-channel waveform data into the waveform memory 21, four microphones 31*a*-31*d* are installed at predetermined four positions for sampling at the four positions. However, the number of the speakers, the number of the channels of waveform data to be stored into the waveform memory 21 per tone and the number of the microphones to be installed at the time of recording of such waveform data are not limited to those specified in the foregoing description of the embodiment. The above-described embodiment may be modified in any desired manner as long as three or more speakers are arranged on a front side region of the electronic piano 1 with at least one other speaker installed at a back position of the electronic piano 1 and waveform data of a plurality of channels sampled at sampling positions corresponding to the positions of the speakers are stored into the memory; such modifications can achieve the same advantageous benefits as the above-described embodiment.

Furthermore, the embodiment of the present invention has been described above in relation to the case where a set of four-channel waveform data are stored in the memory for each key range (region) comprising a plurality of keys. Alternatively, such a set of four-channel waveform data are stored in the memory for each key of the keyboard, namely, 88 different sets of four-channel waveform data may be stored in the memory in association with the 88 keys. Furthermore, the embodiment of the present invention has been described above in relation to the case where each of the waveform data stored in the waveform memory 21 is not waveform data of a whole waveform recorded by the microphone itself, but waveform data having an attack portion and following loop portion created by processing the waveform data of the whole waveform recorded by the microphone. Alternatively, waveform data of the whole waveform from the rise (tone generation start) to the fall (tone generation end) of a generated tone may be stored in the waveform memory 21. In such a case, at the time of tone generation in each of the tone generating channels of the tone generator section 20, the waveform readout/interpolation section 22 only has to read out just once the waveform data from the rise to the fall. The coding scheme for encoding waveform data to be stored into the waveform memory 21 is not limited to the above-mentioned PCM coding scheme and may be any other suitable conventionally-known coding scheme.

Furthermore, whereas the embodiment of the present invention has been described above in relation to the case where waveform data of a grand piano tone color are sampled, waveform data of any other tone color, such as a harpsichord tone color, available in the electronic piano 1 of FIG. 1 may be recorded or sampled at a plurality of predetermined sampling positions by installing microphones with the "on-microphone" setting in accordance with the technical idea or basic principles of the present invention. Namely, according to the present invention, the natural musical instrument to be used at the time of waveform data sampling may be other than the grand piano, such as a cembalo or forte piano, as long the natural musical instrument used has a keyboard and capable of producing tones via strings corresponding to keys on the keyboard.

The present application is based on, and claims priority to, Japanese Patent Application No. 2008-092857 filed on Mar. 31, 2008. The disclosure of the priority application, in its entirety, including the drawings, claims, and the specification thereof, is incorporated herein by reference.

What is claimed is:

1. An electronic keyboard instrument comprising:

a keyboard including a plurality of keys a casing having said keyboard provided on a front side thereof, said casing having a surface extending in a direction from the front side toward a back side thereof;

a plurality of speakers provided on said surface of said casing, said plurality of speakers including three or more speakers arranged substantially parallel to said keyboard on a front region of said surface, and at least one speaker provided at the back of the three or more speakers on said surface;

a waveform memory having stored therein a plurality of waveform data sets each comprising waveform data of a plurality of channels, the waveform data of the plurality of channels being recorded waveform data based on a sound generated by a natural musical instrument having dampers to damp sound, the recorded waveform data being recorded via a plurality of sound pickup devices, corresponding to said plurality of speakers, set close to sounding members of the natural musical instrument arising the sound, said plurality of sound pickup devices positioned over the natural musical instrument analogously to the arrangement of said plurality of speakers on said surface, and three or more of said sound pickup devices, corresponding to said three or more speakers on said front region of said surface, being arranged substantially over said dampers of the natural musical instrument;

a tone signal generation device that reads out, from said waveform memory, the waveform data of the plurality of channels corresponding to a tone designated by key depression on said keyboard and generates tone signals of the plurality of channels based on the read-out waveform data; and a supply device that supplies the tone signals of the plurality of channels, generated by said tone signal generation device, to respective ones of said speakers corresponding in positional arrangement to the plurality of sound pickup devices used for recording the waveform data of the channels.

2. The electronic keyboard instrument as claimed in claim 1 wherein the waveform data of the plurality of channels was recorded with the pickup devices, each positioned close to the sounding members of the natural musical instrument.

3. The electronic keyboard instrument as claimed in claim 1 wherein the natural musical instrument is one of a grand piano, a harpsichord, and a forte piano.

4. The electronic keyboard instrument as claimed in claim 1, wherein as for each of the sound pickup devices corresponding to the three or more speakers, the greatest distance between the corresponding sound pickup device and the sounding members is set at about 25 cm at the most.

5. The electronic keyboard instrument as claimed in claim 1, wherein a mutual distance between adjacent two of said three or more sound pickup devices corresponding to the three or more speakers is adjusted in such a manner that a ratio of the greatest distance between the corresponding sound pickup device and the sounding members to the smallest distance between the corresponding sound pickup device and the sounding members is reduced.

6. The electronic keyboard instrument as claimed in claim 5, wherein the mutual distance between the adjacent two of said three or more sound pickup devices corresponding to the three or more speakers is adjusted such that the ratio is 2.5 or less.

7. The electronic keyboard instrument as claimed in claim 1, wherein the sound pickup device corresponding to said at least one speaker is provided, with the on-microphone setting, at the back of the three or more sound pickup devices, corresponding to the three or more speakers on said surface, near a region where the sounding members of a low-pitch range and the sounding members of a medium-pitch range intersect each other.

* * * * *